US009382911B2

(12) United States Patent
Sun et al.

(10) Patent No.: US 9,382,911 B2
(45) Date of Patent: Jul. 5, 2016

(54) TWO-STAGE CENTRIFUGAL COMPRESSOR WITH EXTENDED RANGE AND CAPACITY CONTROL FEATURES

(71) Applicant: DANFOSS TURBOCOR COMPRESSORS B.V., Amsterdam (NL)

(72) Inventors: Lin Sun, Tallahassee, FL (US); Salvador Quitaleg, Crawfordville, FL (US); Joost Brasz, Fayetteville, NY (US)

(73) Assignee: DANFOSS A/S, Nordborg (DK)

( * ) Notice: Subject to any disclaimer, the term of this patent is extended or adjusted under 35 U.S.C. 154(b) by 0 days.

(21) Appl. No.: 14/479,964

(22) Filed: Sep. 8, 2014

(65) Prior Publication Data

US 2015/0128640 A1 May 14, 2015

Related U.S. Application Data

(60) Provisional application No. 61/904,160, filed on Nov. 14, 2013.

(51) Int. Cl.
*F25B 1/04* (2006.01)
*F04D 17/12* (2006.01)
(Continued)

(52) U.S. Cl.
CPC ..... *F04D 17/122* (2013.01); *F04D 27/0207* (2013.01); *F25B 1/053* (2013.01); *F25B 1/10* (2013.01); *F25B 41/04* (2013.01); *F25B 2400/07* (2013.01); *F25B 2400/13* (2013.01)

(58) Field of Classification Search
CPC ..... F25B 1/04; F04D 23/008; F04D 17/122; F04D 29/66; F04D 29/462; F04D 17/12; F04D 17/0215; F04D 25/16; F04B 35/04; F04B 17/00
USPC ..... 415/160; 417/286, 287, 250; 62/115, 62/498
See application file for complete search history.

(56) References Cited

U.S. PATENT DOCUMENTS 2,656,096 A * 10/1953 Schwarz ..... 417/323
3,901,620 A 8/1975 Boyce
(Continued)

FOREIGN PATENT DOCUMENTS

DE 842893 C 7/1952
WO 2013128093 A1 9/2013
WO 2013139568 A1 9/2013

OTHER PUBLICATIONS

International Search Report and Written Opinion for International Application No. PCT/US2010/055201, mailed Dec. 29, 2010.
(Continued)

*Primary Examiner* — Justin Jonaitis
*Assistant Examiner* — Stephen Mick
(74) *Attorney, Agent, or Firm* — Carlson, Gaskey, & Olds P.C.

(57) ABSTRACT

One exemplary embodiment of this disclosure relates to a centrifugal refrigerant compressor system. The system includes a condenser, an evaporator, and an economizer between the condenser and the evaporator. The system further includes a centrifugal compressor having a first impeller and a second impeller downstream of the first impeller. The compressor includes at least one port. Fluid from a recirculation flow path and an economizer flow path is introduced into a main flow path of the compressor by way of the at least one port.

9 Claims, 3 Drawing Sheets

(51) Int. Cl.

| | |
|---|---|
| ***F25B 1/053*** | (2006.01) |
| ***F25B 1/10*** | (2006.01) |
| ***F25B 41/04*** | (2006.01) |
| ***F04D 27/02*** | (2006.01) |

(56) References Cited

U.S. PATENT DOCUMENTS

| | | | | |
|---|---|---|---|---|
| 4,094,613 | A | 6/1978 | Bracken | |
| 4,695,224 | A | 9/1987 | Lown | |
| 5,669,756 | A | 9/1997 | Brasz et al. | |
| 5,857,348 | A | 1/1999 | Conry | |
| 6,036,432 | A | 3/2000 | Sishtla et al. | |
| 6,129,511 | A * | 10/2000 | Salvage et al. | 415/150 |
| 6,375,438 | B1 * | 4/2002 | Seo | 417/366 |
| 6,672,826 | B2 | 1/2004 | LeDuc | |
| 6,997,686 | B2 * | 2/2006 | Agrawal et al. | 417/350 |
| 7,326,027 | B1 | 2/2008 | Skoch et al. | |
| 7,353,660 | B2 * | 4/2008 | Lifson | B60H 1/00885 62/199 |
| 7,871,239 | B2 | 1/2011 | Sorokes | |
| 8,021,104 | B2 | 9/2011 | Gu et al. | |
| 8,122,724 | B2 | 2/2012 | Slovisky et al. | |
| 8,210,793 | B2 | 7/2012 | Hale | |
| 8,245,530 | B2 * | 8/2012 | Sugitani | 62/498 |
| 8,287,232 | B2 * | 10/2012 | Gu et al. | 415/56.5 |
| 8,567,184 | B2 | 10/2013 | Scotti Del Greco et al. | |
| 8,567,207 | B2 * | 10/2013 | Sommer et al. | 62/228.1 |
| 2005/0223737 | A1 | 10/2005 | Conry | |
| 2009/0087321 | A1 | 4/2009 | Morozumi | |
| 2009/0213686 | A1 | 8/2009 | Heikkilae et al. | |
| 2010/0129205 | A1 | 5/2010 | Schwerdel | |
| 2011/0277498 | A1 | 11/2011 | Kaart | |
| 2012/0048387 | A1 | 3/2012 | Galeotti | |
| 2012/0073318 | A1 * | 3/2012 | Lifson et al. | 62/115 |
| 2013/0036760 | A1 | 2/2013 | Sun et al. | |
| 2013/0209222 | A1 | 8/2013 | Schofield | |
| 2013/0220289 | A1 | 8/2013 | Maceroni et al. | |
| 2013/0236300 | A1 | 9/2013 | Hiller et al. | |

OTHER PUBLICATIONS

International Search Report and Written Opinion for PCT Application No. PCT/US14/67522, mailed Dec. 31, 2014.

* cited by examiner

TWO-STAGE CENTRIFUGAL COMPRESSOR WITH EXTENDED RANGE AND CAPACITY CONTROL FEATURES

RELATED APPLICATIONS

This application claims the benefit of U.S. Provisional Application No. 61/904,160, filed Nov. 14, 2013, the entirety of which is herein incorporated by reference.

BACKGROUND

Refrigerant compressors are used to circulate refrigerant in a chiller via a refrigerant loop. One type of known refrigerant compressor operates at fixed speed and has a set of variable inlet guide vanes arranged at a compressor inlet, upstream from an impeller. The variable inlet guide vanes are actuated during operation of the refrigerant compressor to regulate capacity during various operating conditions.

Other known refrigerant compressors have additionally employed a variable-geometry diffuser downstream from an impeller to improve capacity control during part-load operating conditions. Variable-geometry diffusers adjust the diffuser cross-sectional flow area to the low flow rate encountered under part-load conditions, thus maintaining flow angles and velocities similar to those at full-load design conditions.

One prior refrigerant compressor concept suggested recirculating refrigerant to improve capacity control. In U.S. Pat. No. 5,669,756 to Brasz, for example, the refrigerant is recirculated from a diffuser exit, and is injected back into a main flow path at the impeller.

SUMMARY

One exemplary embodiment of this disclosure relates to a centrifugal refrigerant compressor system. The system includes a condenser, an evaporator, and an economizer between the condenser and the evaporator. The system further includes a centrifugal compressor having a first impeller and a second impeller downstream of the first impeller. The compressor includes at least one port. Fluid from a recirculation flow path and an economizer flow path is introduced into a main flow path of the compressor by way of the at least one port.

Another exemplary embodiment of this disclosure relates to a centrifugal refrigerant compressor. The compressor includes a first impeller, and a second impeller downstream of the first impeller. The compressor further includes a port in fluid communication with a recirculation flow path, the port provided either (1) adjacent a return channel between the first and second impellers, or (2) downstream of the second impeller.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The drawings can be briefly described as follows.

DETAILED DESCRIPTION

Figure 1:
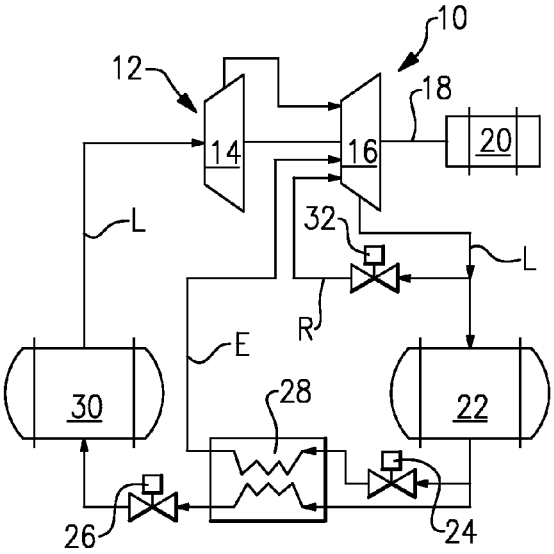
FIG. 1 schematically illustrates a first example refrigerant system according to this disclosure.

FIG. 1 schematically illustrates a first example refrigerant system 10. The refrigerant system 10 includes a compressor 12. In this example, the compressor 12 is a centrifugal compressor including first and second impellers 14, 16, meaning the compressor 12 is a two-stage compressor. The first and second impellers 14, 16 are mounted along a shaft 18, which is rotationally driven by a motor 20. The speed of the motor 20 is adjustable to (at least partially) regulate the capacity of the compressor 12. The compressor 12 is configured to pressurize a flow of fluid, which is refrigerant in this example, within a refrigerant loop L.

Downstream of the compressor 12, the system 10 includes a condenser 22, which is upstream of first and second expansion valves 24, 26. The first expansion valve 24 is upstream of an economizer 28 and is controllable by a controller (not shown) to direct a first flow of fluid through the economizer 28. The first flow of fluid cools a second flow of fluid flowing through the economizer 28 toward the second expansion valve 26, which is downstream of the economizer 28. An evaporator 30 is positioned downstream of the second expansion valve 26 and upstream of the compressor 12.

The compressor 12 is in fluid communication with an economizer flow path E, which is sourced from the refrigerant loop L at the economizer 28. Further, the compressor 12 is in fluid communication with a recirculation flow path R. In this example, the recirculation flow path R is sourced from the refrigerant loop L at a location downstream of the second impeller 16, such as an outlet (or exit) of the compressor 12. The economizer and recirculation flow paths E, R will be discussed in detail below.

Figure 2:
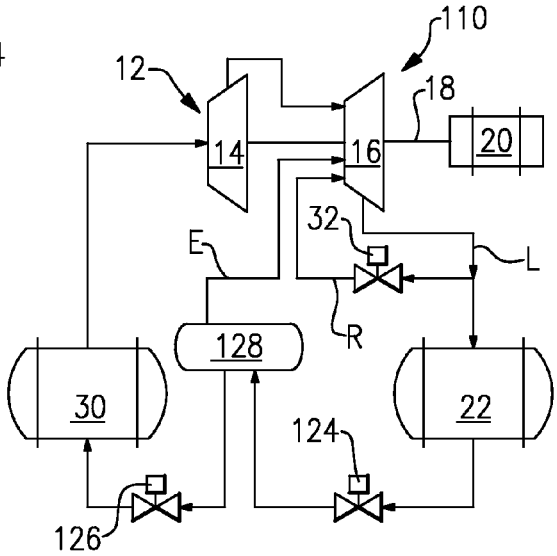
FIG. 2 schematically illustrates a second example refrigerant system.

FIG. 2 illustrates another refrigerant system 110 according to this disclosure. Like the system 10, the system 110 includes a compressor 12 configured to pressurize a flow of fluid within a refrigerant loop L. Downstream of the compressor 12, system 110 includes a condenser 22, which is upstream of first and second expansion valves 124, 126. Between the first and second expansion valves 124, 126, the system 110 includes an economizer 128, which in this example is an economizer tank (also known as a "flash" tank).

The first expansion valve 124 is upstream of the economizer 128, and the second expansion valve 126 is provided between the economizer 128 and an evaporator 30, which is upstream of the compressor 12.

In the system 110, the compressor 12 is in fluid communication with an economizer flow path E, which is sourced from the refrigerant loop L at the economizer 128. Further, the compressor 12 is in fluid communication with a recirculation flow path R Like the system 10, the recirculation flow path R is sourced from the refrigerant loop L at a location downstream of the second impeller 16.

Figure 3:
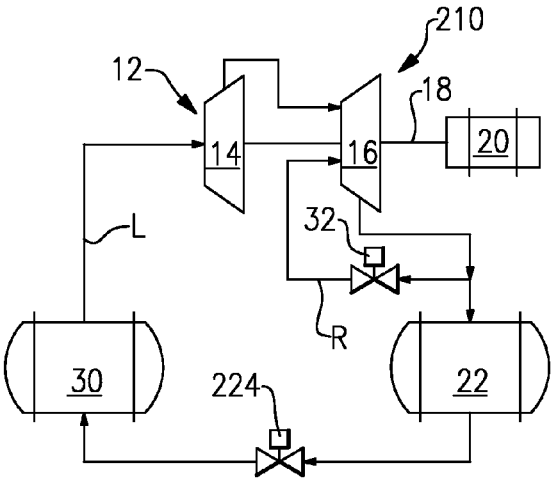
FIG. 3 schematically illustrates a third example refrigerant system.

FIG. 3 illustrates a system 210 that does not include an economizer. In the system 210, there is a compressor 12, and a condenser 22 downstream of the compressor 12. Since there is no economizer, the system 210 only includes a single expansion valve 224 (such as the valves 26, 126), which is downstream of the condenser 22 and upstream of the evaporator 30. The system 210 includes a recirculation flow path R, which, like the prior-discussed examples, is sourced from a location downstream of the second impeller 16.

FIGS. 4-9 schematically illustrate six example compressors 112, 212, 312, 412, 512, and 612. Each of these compressors 112, 212, 312, 412, 512, and 612 may be used as the compressor 12 in any one of the systems 10, 110, 210 illustrated between FIGS. 1-3.

Figure 4:
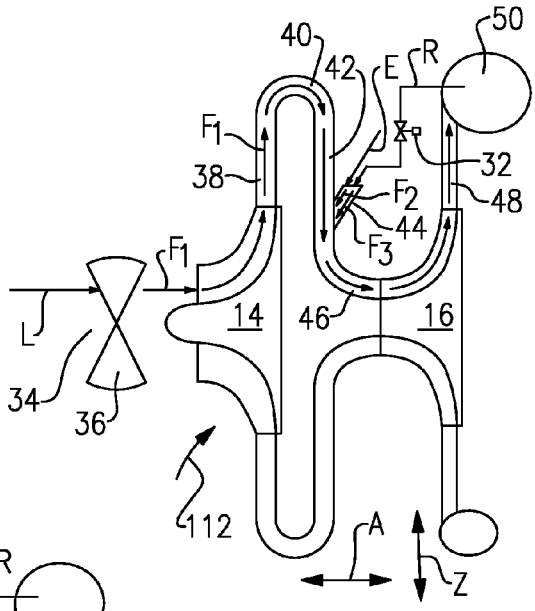
FIG. 4 schematically illustrates a first example compressor.

FIG. 4 schematically illustrates a first example compressor 112. The compressor 12 includes an inlet, at 34, including controllable inlet guide vanes 36. The inlet guide vanes 36 are configured to control capacity of the compressor 112 by throttling a flow of fluid $F_1$ from the refrigerant loop L. The flow path of the fluid $F_1$ is referred to herein as the main flow path of the compressor 112. In another example of this disclosure, the compressor 112 does not include inlet guide vanes 36.

In this example, the fluid $F_1$ enters the compressor 112 via the inlet 34, and flows axially (in the axial direction A) over the inlet guide vanes 36 and toward the first impeller 14. The first impeller 14 pressurizes the fluid $F_1$, and radially expels (in the radial direction Z) the fluid $F_1$ downstream toward a first vaneless diffuser 38. Then, a crossover bend 40 turns the fluid $F_1$ radially inward toward a return channel 42, which may include deswirl vanes.

The compressor 112 includes a port 44 (which itself may be provided by a number of gas injection holes) provided adjacent the return channel 42. In this example, the port 44 is fluid communication with the economizer flow path E and the recirculation flow path R. Fluid from the economizer flow path E is illustrated at $F_2$, and fluid from the recirculation flow path R is illustrated at $F_3$.

The recirculation fluid $F_3$ is controllable via the flow regulator 32 to selectively introduce the flow of fluid $F_3$ into the port 44. The flow regulator 32 is controlled via a controller (not pictured) to introduce the fluid $F_3$ into the fluid $F_1$ at select times. In one example, the flow regulator 32 is closed when the compressor 112 is operating at a normal capacity. A normal capacity range is about 40-100% of the designed capacity. At relatively low, part-load operating capacities (e.g., around 30% of the designed capacity), however, the controller instructs the inlet guide vanes 36 to close and the flow regulator 32 to open, such that fluid $F_3$ flows to the port 44 via the recirculation flow path R. Additionally or alternatively, the controller may instruct the flow regulator 32 to open during compressor start-up in some examples.

With continued reference to FIG. 4, the combined flows of fluid $F_1$-$F_3$ flow from the return channel 42 to the return channel exit 46. Then, the combined fluids $F_1$-$F_3$ are pressurized by the second impeller 16, and are radially expelled toward a second vaneless diffuser 48. Finally, the combined fluids $F_1$-$F_3$ flow to an outlet volute 50. The outlet volute 50 need not be in the form of a volute, however, and other types of outlets come within the scope of this disclosure.

In the example of FIG. 4, the recirculation flow path R is provided between the outlet volute 50 and the port 44, and, as mentioned, the flow regulator 32 selectively taps a portion of the fluid within the main flow path for recirculation. The recirculation flow path R could be sourced from another location, including any location downstream of the second impeller 14 and upstream of the condenser 22.

The injection of fluid from the economizer flow path E and/or the recirculation flow path R increases the stability of operation of the compressor 112 in part-load conditions by allowing the downstream elements (e.g., the second impeller 16) to experience flows closer to their optimum range.

Figure 5:
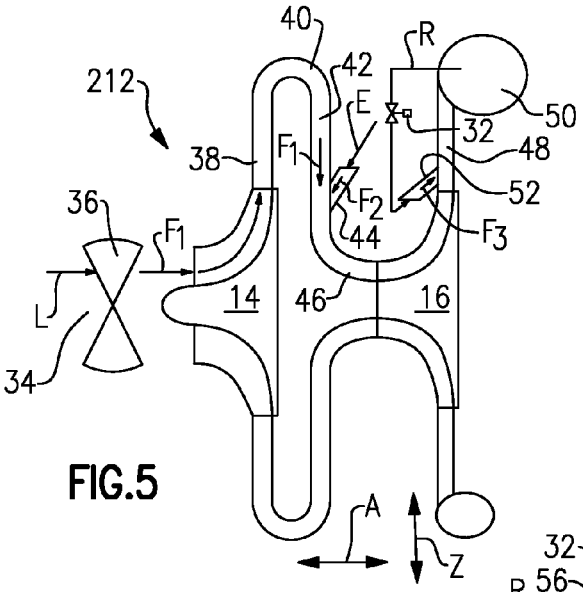
FIG. 5 schematically illustrates a second example compressor.

FIG. 5 illustrates a second example compressor 212. Unlike the compressor 112, in which both the economizer flow path E and the recirculation flow path R are in communication with the port 44, the compressor 212 includes a second port 52 downstream of the second impeller 16. In this example, the second port 52 is in fluid communication with the recirculation flow path R, and is arranged to inject the fluid $F_3$ adjacent the second vaneless diffuser 48. Like the compressor 112, the economizer flow path E is in fluid communication with the port 44.

Injecting the fluids $F_2$ and $F_3$ via the ports 44 and 52 stabilizes the second stage impeller 16 during off-load conditions. Further, compared to FIG. 4, in which the fluid $F_3$ is injected via the port 44, injecting the fluid $F_3$ downstream of the second impeller 16 may have the benefit of improving overall compressor efficiency because there is no work that has been done to the fluid $F_3$ at that point (e.g., the fluid F3 was not pressurized by the second impeller 16 before being introduced into the main flow path).

The compressors 112, 212 of FIGS. 4-5 provide a higher peak efficiency, albeit within a relatively narrow operating range. Unlike the compressors 112, 212 of FIGS. 4-5, the compressors 312, 412, 512, and 612 of FIGS. 6-9 do not include inlet guide vanes 36. Instead, capacity is controlled by injecting fluid from the recirculation flow path R downstream of the first impeller 14, as discussed below.

Figure 6:
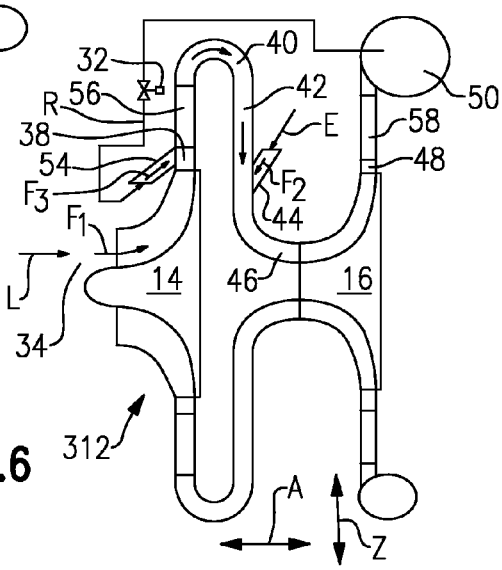
FIG. 6 schematically illustrates a third example compressor.

With reference to the compressor 312 of FIG. 6, a flow of fluid $F_1$ is introduced to the inlet 34 from the refrigerant loop L. The flow of fluid $F_1$ is pressurized by the first impeller 14 and is radially expelled toward a first vaneless diffuser 38. Adjacent the first vaneless diffuser 38, in this example, a recirculation port 54 is arranged to introduce a flow of fluid $F_3$ from the recirculation flow path R. As in the above-discussed examples, the recirculation flow path R is sourced at the outlet volute 50.

The arrangement of the recirculation flow path R in FIG. 6 is the same as the arrangement of the recirculation flow path R described in co-pending U.S. patent application Ser. No. 14/096,395, the entirety of which is herein incorporated by reference. As explained in the '395 Application, the recirculation flow path R may be in communication with a recirculation volute and a plurality of injection nozzles, however this disclosure extends to other types of arrangements.

With continued reference to FIG. 6, the compressor 312 includes a first vaned diffuser 56, which includes a plurality of stationary (or, fixed) vanes, downstream of the first vaneless diffuser 38. The combined flows of fluid $F_1$ and $F_3$ flow radially through the first vaned diffuser 56 to a crossover bend 40, which radially turns the combined fluids $F_1$, $F_3$ toward the return channel 42.

As in the examples of FIGS. 4 and 5, the compressor 312 includes a port 44 adjacent the return channel 42. The port 44 is arranged to inject the fluid $F_2$ from the economizer flow path E into the compressor 312. Next, the combined fluids $F_1$-$F_3$ flow downstream to a second impeller 16 where they are pressurized and radially expelled. Downstream of the second impeller 16, the compressor 312 includes a second vaneless diffuser 48 and a second vaned diffuser 58. The second vaned diffuser 58 is downstream of the second vaneless diffuser 48 and upstream of the outlet volute 50. Like the first vaned diffuser 56, the second vaned diffuser 58 includes stationary vanes.

The injection of the fluid $F_3$ from the recirculation flow path R increases the stability of operation of the compressor 312 in part-load conditions by allowing the downstream elements (e.g., the first vaned diffuser 56, the second impeller 16, and the second vaned diffuser 58) to experience flows closer to their optimum range. The injection of the fluid $F_2$ further stabilizes the elements downstream of the port 44, namely the second impeller 16 and the second vaned diffuser 58. In turn, injecting the fluids $F_2$, $F_3$ extends the efficient operating range of the compressor 312 to lower, part-load operating conditions, which reduces the likelihood of a surge condition. Further, the compressor 312 does not require inlet guide vanes or variable geometry diffusers, which reduces the mechanical components within the compressor 312 and leads to increased reliability.

Figure 7:
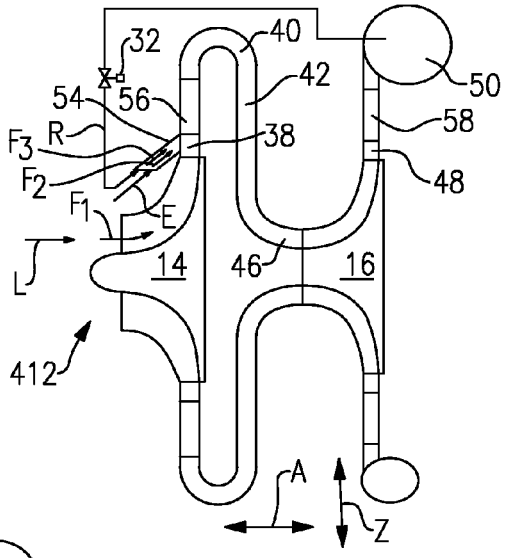
FIG. 7 schematically illustrates a fourth example compressor.

FIG. 7 illustrates a compressor 412 that is similar to the compressor 312 of FIG. 6, however the compressor 412 does not include a port (such as the port 44) adjacent the return channel 42. Instead, in the compressor 412, the fluid $F_2$ from the economizer flow path E and the fluid $F_3$ from the recirculation flow path R are each introduced into the compressor 412 via the port 54. This simplifies the construction of the compressor 412 by eliminating a port.

While the FIGS. 6 and 7 include a first vaned diffuser 56 having stationary vanes, other compressors (such as the compressors 512, 612 of FIGS. 8 and 9) may include a variable geometry diffuser 60 downstream of the first impeller 14. The vanes of the variable geometry diffuser 60 are adjustable to control the capacity of the compressors 512, 612. The compressors 512, 612 can effectively control capacity without the need for inlet guide vanes.

Figure 8:
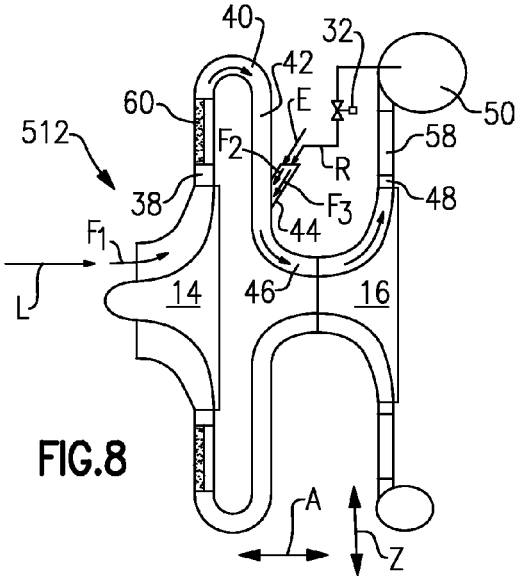
FIG. 8 schematically illustrates a fifth example compressor.

FIG. 8 illustrates a first example compressor 512 including a variable geometry diffuser 60 downstream of the first impeller 14. The compressor 512 also includes a vaned diffuser 58 downstream of the second impeller 16. As shown in FIG. 8, the flows of fluid $F_2$, $F_3$ are injected into the compressor 12 via a port 44 adjacent the return channel 42, in substantially the same way as in the compressor 112 of FIG. 4. Thus, the capacity of the compressor 512 is effectively controlled by the variable geometry diffuser of the first impeller 14, while the injection of the fluids $F_2$, $F_3$ via the port 44 stabilize the second impeller 16 as mentioned above relative to the compressor 112.

Figure 9:
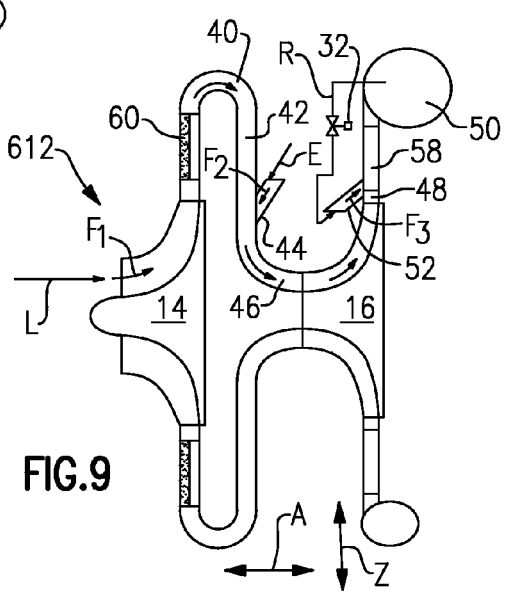
FIG. 9 schematically illustrates a sixth example compressor.

FIG. 9 illustrates a second example compressor 612 including a variable geometry diffuser 60 downstream of the first impeller 14. The compressor 612 includes a vaned diffuser 58 downstream of the second impeller 16. Similar to FIG. 5, the economizer flow path E is in fluid communication with the compressor 12 via the port 44, and the recirculation flow path R is in fluid communication with a second port 52 downstream of the second impeller 16.

In each of the compressors 112, 212, 312, 412, 512, and 612, the flow of fluid $F_2$ from the economizer flow path E may be a consistent, steady flow, proportional to the capacity of the compressor.

As mentioned above, in some examples there is no economizer flow path E (because there is no economizer, such as in the example of FIG. 3). In these instances, the compressors 212, 312, and 612 may exclude the port 44 (note that the compressors 112 and 512 inject the fluid $F_3$ via the port 44, and thus there is still a need for the port 44 even when the economizer flow path E is eliminated).

It should be understood that terms such as "fore," "aft," "axial," "radial," and "circumferential" are used for purposes of explanation, and should not be considered otherwise limiting. Terms such as "generally," "substantially," and "about" are not intended to be boundaryless terms, and should be interpreted consistent with the way one skilled in the art would interpret the term.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A centrifugal refrigerant compressor system, comprising:

a condenser;

an evaporator;

an economizer between the condenser and the evaporator; and a centrifugal compressor including a first impeller and a second impeller downstream of the first impeller, the compressor including at least one port provided at a location downstream of the first impeller, wherein fluid from a recirculation flow path and an economizer flow path is introduced into a main flow path of the compressor by way of the at least one port, wherein the recirculation flow path is provided directly between an outlet of the compressor and the at least one port, wherein the at least one port is a single port provided downstream of the first impeller and upstream of the second impeller, and wherein the port is provided adjacent a return channel between the first and second impellers.

2. The refrigerant system as recited in claim 1, wherein the economizer flow path is sourced from the economizer.

3. The refrigerant system as recited in claim 1, wherein the compressor includes one of a variable geometry diffuser and inlet guide vanes.

4. The refrigerant system as recited in claim 3, wherein the compressor includes a variable geometry diffuser downstream of the first impeller, and wherein the compressor further includes a stationary vane diffuser downstream of the second impeller.

5. The refrigerant system as recited in claim 3, wherein the compressor includes inlet guide vanes, and wherein the compressor further includes first and second vaneless diffusers downstream of the first and second impellers, respectively.

6. The refrigerant system as recited in claim 1, wherein the compressor further includes a stationary vane diffuser downstream of the first impeller, and wherein the port is adjacent the stationary vane diffuser.

7. A centrifugal refrigerant compressor, comprising:

a first impeller;

a second impeller downstream of the first impeller; and a single port in fluid communication with a recirculation flow path and an economizer flow path, wherein the recirculation flow path is provided directly between an outlet of the centrifugal refrigerant compressor and the port, wherein the port is provided downstream of the first impeller, and wherein the port is configured to inject fluid from the recirculation flow path and the economizer flow path into a return channel between the first and second impellers.

8. The centrifugal refrigerant compressor as recited in claim 7, wherein the outlet of the centrifugal refrigerant compressor is provided by a volute.

9. The refrigerant system as recited in claim 1, wherein the outlet of the compressor is provided by a volute.

* * * * *